US006048462A

United States Patent [19]

Daskopoulos et al.

[11] Patent Number: 6,048,462

[45] Date of Patent: Apr. 11, 2000

[54] WASTE COMPONENT REMOVAL FROM CRUDE OIL OR GAS

[75] Inventors: Phaidon Daskopoulos, Amsterdam; Alexander Michiel Mollinger, Rijswijk; Paul Dirk Schilte, Rijswijk; Robert Gerard Smeenk, Rijswijk; Paulus Henricus Joannes Verbeek, Rijswijk; Marinus Hendricus Wilhelmus Verbruggen, Rijswijk, all of Netherlands

[73] Assignee: Shell Oil Company, Houston, Tex.

[21] Appl. No.: 09/035,515

[22] Filed: Mar. 5, 1998

[30] Foreign Application Priority Data

Mar. 14, 1997 [EP] European Pat. Off. ..... 97200772

[51] Int. Cl.[7] ..... E21B 41/00; E21B 43/28

[52] U.S. Cl. ..... 210/668; 210/747; 166/266; 405/128

[58] Field of Search ..... 210/660, 663, 210/668, 747, 170, 634; 166/265, 266, 105.5; 405/128

[56] References Cited

U.S. PATENT DOCUMENTS

| | | | |
|---|---|---|---|
| 3,817,859 | 6/1974 | Tate | 210/747 |
| 4,805,697 | 2/1989 | Fouillout et al. | 166/265 |
| 5,439,058 | 8/1995 | Malbrel et al. | 166/300 |
| 5,730,871 | 3/1998 | Kennedy et al. | 210/170 |

FOREIGN PATENT DOCUMENTS

| | | |
|---|---|---|
| 0 227 291 A1 | 1/1987 | European Pat. Off. . |
| 2285055 | 6/1995 | United Kingdom . |
| 95/14543 | 6/1995 | WIPO . |

*Primary Examiner*—David A. Simmons
*Assistant Examiner*—Frank M. Lawrence

[57] ABSTRACT

A method is provided of reducing an amount of a waste component present in a hydrocarbon fluid produced from an earth formation via a wellbore formed in the earth formation, the hydrocarbon fluid flowing in a stream of fluid through the wellbore. The method includes (a) inducing at least part of the amount of the waste component to move into a second fluid present in the stream of fluid; (b) separating the second fluid with the at least part of the amount of the waste component included therein, from the hydrocarbon fluid; and (c) disposing the second fluid with the waste component included therein by injecting it into the earth formation via at least one of the wellbore and another wellbore formed in the earth formation.

19 Claims, No Drawings

WASTE COMPONENT REMOVAL FROM CRUDE OIL OR GAS

FIELD OF THE INVENTION

The invention relates to a method of reducing an amount of a waste component present in a hydrocarbon fluid in a stream of fluid produced from an earth formation.

BACKGROUND OF THE INVENTION

Many oil or gas wells produce, simultaneously with the desired hydrocarbon fluid, undesired waste components such as production water, $H_2S$ and $CO_2$. In the case of production water, the ratio of produced water/hydrocarbon fluid of most wells increases during the lifetime of the well. This phenomenon is due to the fact that for most hydrocarbon reservoirs in the earth formation the oil layer is located on top of a layer of water of which the level increases as the reservoir is depleted due to continued oil production. The produced water is generally separated from the oil using suitable separating means, for example settling tanks.

Apart from the produced water waste components like $H_2S$ and $CO_2$ are also produced in substantial amounts as these gases are dissolved in the produced oil and water. These components cause undesired environmental pollution if not adequately removed from the hydrocarbon fluid. It is therefore common technology to remove such waste components, for example using a regenerative treatment process. Such process requires dedicated process equipment downstream the wellbore at surface, which equipment is generally expensive and adds to the overall cost of the hydrocarbon production operation.

It is an object of the invention to provide an improved method of reducing an amount of a waste component present in a hydrocarbon fluid in a stream of fluid produced from an earth formation, which method requires less dedicated process equipment.

SUMMARY OF THE INVENTION

In accordance with the invention there is provided a method of reducing an amount of a waste component present in a hydrocarbon fluid produced from an earth formation via a wellbore formed in the earth formation, the hydrocarbon fluid flowing in a stream of fluid through the wellbore: the method comprising a) inducing at least part of the amount of the waste component to move into a second fluid present in the stream of fluid;

b) separating the second fluid with said at least part of the amount of the waste component included therein, from the hydrocarbon fluid; and c) disposing the second fluid with said waste component included therein by injecting it into the earth formation via at least one of said wellbore and another wellbore formed in the earth formation.

DETAILED DESCRIPTION

By injecting the second fluid with the waste component therein, into the earth formation, it is achieved that the waste component is returned to its source, i.e. to the earth formation, without causing environmental pollution and without the need for dedicated waste removal equipment at surface. In effect, a zero waste hydrocarbon fluid production operation is achieved with the method according to the invention.

To further reduce the amount of processing equipment at surface, it is preferred that the second fluid with said at least part of the amount of the waste component included therein is separated from the hydrocarbon fluid in the wellbore.

Suitably, said at least part of the amount of the waste component is induced to move into the second fluid present in the stream of fluid, as said stream flows through the wellbore.

Preferably step a) comprises dissolving said at least part of the amount of the waste component in the second fluid, and step b) comprises separating the second fluid with the waste component dissolved therein, from the hydrocarbon fluid.

The method of the invention is particularly, but not exclusively, suitable for removing $H_2S$ and $CO_2$ from hydrocarbon fluid such as oil, since most produced oils contain dissolved $H_2S$ and $CO_2$ which should be prevented from being released to the atmosphere.

Suitably step a) comprises:

i) selecting a substance which reacts with the waste component to form a reaction product which is soluble in the second fluid;

ii) inducing the selected substance to be present in said stream of fluid in the wellbore, whereby said substance reacts with the waste component and the reaction product substantially dissolves in the second fluid of the stream of fluid.

The method of the invention is most efficient if the selected substance is induced to be present in a lower part of the wellbore where the hydrocarbon fluid enters the wellbore. This can be achieved, for example, by injecting said substance into the stream of fluid in the wellbore via a conduit extending into the wellbore.

In an attractive embodiment, the second fluid is production water produced simultaneously with the hydrocarbon fluid from the earth formation via said wellbore. The amount of selected substance to be used can be reduced by separating part of the production water from the stream of fluid prior to inducing the substance to be present in the stream of fluid, so that the reaction product substantially dissolves in the remaining part of the production water.

In case the waste components include $H_2S$ and $CO_2$, it is preferred to apply $OH^-$ ions in the stream of fluid so that the reaction product includes at least one of the group of $HS^-$, $S^{2-}$, $HCO_3^-$ and $CO_3^{2-}$ ions. The $OH^-$ ions can be formed by injecting a base into the stream of fluid, or alternatively by electrolysis of the second fluid, for example using a bipolar membrane.

The invention will be described in more detail in the following examples.

EXAMPLE 1

Hydrocarbon fluid in the form of oil and gas is produced from an earth formation via a wellbore. The stream of produced fluid flows to surface through a production tubing extending into the wellbore. Generally the stream of fluid includes a substantial amount of production water from the earth formation. Furthermore, waste components like $H_2S$ and/or $CO_2$ are also present as these components are dissolved in both the oil phase and the water phase. In order to remove $H_2S$ and/or $CO_2$ from the oil phase, a base in the form of NaOH is injected into the stream of fluid (e.g. by injecting it into the production tubing or into the annular space between the production tubing and the wellbore casing) so as to mix with the stream of oil and production water. The injected NaOH forms $OH^-$ ions in the water phase which react with $H_2S$ and $CO_2$ according to $$H_2S+OH^- \Leftrightarrow HS^-+H_2O$$

$$HS^-+OH^- \Leftrightarrow S^{2-}+H_2O$$

overall:

$$H_2S+2OH^- \Leftrightarrow S^{2-}+2H_2O$$

$CO_2$ or $H_2CO_3$ ($CO_2+H_2O$) can react with a base according to $$H_2CO_3+OH^- \Leftrightarrow HCO_3^-+H_2O \text{ or } CO_2+OH^- \Leftrightarrow HCO_3^-$$

$$HCO_3^-+OH^- \Leftrightarrow CO_3^{2-}+H_2O$$

overall:

$$H_2CO_3+2OH^- \Leftrightarrow CO_3^{2-}+2H_2O \text{ or } CO_2+2OH^- \Leftrightarrow CO_3^{2-}+H_2O$$

wherein the ions $HS^-$, $S^{2-}$, $HCO_3^-$ and $CO_3^{2-}$ are dissolved in the water phase; only $H_2S$ and $CO_2$ can be dissolved in both the water- and the oil phase. Thus, by adding the base in the form of NaOH the concentration of the $HS^-$, $S^{2-}$, $HCO_3^-$ and $CO_3^{2-}$ ions in the water phase increases, leading to a decrease of $H_2S$ and $CO_2$ in the oil phase. This effectively implies a transfer of $H_2S$ and $CO_2$ from the oil phase to the water phase.

Optionally, before adding the base at least part of the production water is separated from the fluid stream, the advantage being that less amount of base is to be added in order to achieve the desired pH.

Conversely, when the concentration of $H_2S$ and $CO_2$ in the oil phase is relatively high, an extra injection water stream can be mixed with the total oil/water stream produced from the wellbore in order to create a larger water volume in which the $H_2S$ and $CO_2$ and the resulting ions are dissolved.

Subsequently the water phase in which the ions $HS^-$, $S^{2-}$, $HCO_3^-$ and $CO_3^{2-}$ are dissolved, is separated from the oil phase using one or more separators (for example cyclone separators) which can be positioned in the wellbore or at surface. The separated water with the dissolved ions is subsequently injected into the earth formation via an injection tubing extending in the wellbore. Alternatively the water with the dissolved ions can be injected into the earth formation via another wellbore. In case the above indicated ions have a tendency of scale precipitation in the injection tubing, a scale inhibitor or an acid can be added to the water stream in the injection tubing to prevent such scaling or to dissolve precipitated scale.

EXAMPLE 2

A stream of hydrocarbon fluid (oil/gas) containing $H_2S$ and $CO_2$ is produced from an earth formation via a production tubing in a wellbore, the difference from example 1 being that there is no water simultaneously produced from the formation. In order to apply the method according to the invention, a second fluid in the form of water is inserted into the stream of fluid by injecting the second fluid through a suitable conduit into the stream of fluid via the wellbore. The amount of second fluid to be injected depends on the amounts of $H_2S$ and $CO_2$ in the hydrocarbon fluid, but generally (in case of oil production) an amount as low as 2–3 wt % of the oil flow rate is sufficient.

The second fluid is injected to mix with the hydrocarbon fluid in the annular space between the production tubing and the wellbore casing, at the level of the producing zone. Prior to injecting the water into the hydrocarbon fluid stream, NaOH has been added to the water which furthermore has been made substantially free of scale-forming components like barium, strontium and calcium. NaOH forms $OH^-$ ions in the water phase, which react with the $H_2S$ and $CO_2$ present in the stream of fluid according to the reactions referred to in example 1. It is thereby achieved that effectively the $H_2S$ and $CO_2$ are moved into the second fluid, i.e. into the water phase. The water with the dissolved $HS^-$, $S^{2-}$, $HCO_3^-$ and $CO_3^{2-}$ ions is produced to surface where it is separated from the hydrocarbon fluid. Alternatively, the step of separating the water with the dissolved ions from the hydrocarbon fluid can be carried out in the wellbore. In the latter case, small sized cyclone separators fitting in the wellbore, can be applied.

The separated water with the dissolved ions is subsequently injected into the earth formation via the same or another wellbore formed in the earth formation.

The contact between water and the oil can be intensified, for example, by using a contactor, a pump for pumping the stream of oil and water, or a centrifuge.

It will be appreciated that in the above examples NaOH has been indicated as a suitable substance to be added to the fluid stream only by way of example, and that there are numerous other substances which are suitable for carrying out the method of the invention. Examples of such substances are $Ca(OH)_2$, $Mg(OH)_2$, LiOH and KOH.

The amount of base to be used in applying the invention can be determined from stoichiometric conditions. For example, approximately 1.82 kg NaOH would be needed per kg $CO_2$ to be removed, and approximately 2.35 kg NaOH is needed per kg $H_2S$ to be removed.

It will be appreciated that the method according to the invention can be applied both at onshore and offshore oil/gas production wells.

We claim:

1. A method of reducing an amount of a waste component present in a hydrocarbon fluid produced from an earth formation via a wellbore formed in the earth formation, the hydrocarbon fluid flowing in a stream of fluid through the wellbore, the method comprising:

a) inducing at least part of the amount of the waste component to move into a second fluid present in the stream of fluid inside the well before;

b) separating the second fluid with said at least part of the amount of the waste component included therein from the hydrocarbon fluid; and c) disposing the second fluid with said waste component included therein by injecting said second fluid into the earth formation via at least one of said wellbore and another wellbore formed in the earth formation.

2. The method of claim 1, wherein step a) comprises dissolving said at least part of the amount of the waste component in the second fluid, and wherein step b) comprises separating the second fluid with the waste component dissolved therein from the hydrocarbon fluid.

3. The method of claim 2, wherein the waste component comprises at least one of $H_2S$ and $CO_2$.

4. The method of claim 2, wherein step a) comprises:

i) selecting a substance which reacts with the waste component to form a reaction product which is soluble in the second fluid;

ii) inducing the selected substance to be present in said stream of fluid in the wellbore, whereby said substance reacts with the waste component and the reaction product substantially dissolves in the second fluid.

5. The method of claim 4 wherein step ii) comprises inducing the substance to be present in a lower part of the wellbore where the hydrocarbon fluid enters the wellbore.

6. The method of claim 4, wherein the waste component comprises at least one of $H_2S$ and $CO_2$, and wherein said substance includes $OH^-$ ions, the reaction product including at least one of the group of $HS^-$, $S^{2-}$, $HCO_3^-$ and $CO_3^{2-}$ ions.

7. The method of claim 6, wherein the $OH^-$ ions are formed by at least one of the steps of injecting a base into the stream of fluid, and electrolysis of the second fluid.

8. The method of claim 7, wherein said substance is injected into the stream of fluid in the wellbore via a conduit extending into the wellbore.

9. The method of claim 1, wherein the second fluid is production water produced simultaneously with the hydrocarbon fluid from the earth formation via said wellbore.

10. The method of claim 4, wherein the second fluid is production water produced simultaneously with the hydrocarbon fluid from the earth formation via said wellbore.

11. The method of claim 10, wherein prior to inducing said substance to be present in the stream of fluid, part of the production water is separated from the stream of fluid, whereby said reaction product substantially dissolves in the remaining part of the production water.

12. The method of claim 1, wherein the second fluid is inserted in the stream of fluid by injecting it into the stream of fluid via the wellbore.

13. The method of claim 12, wherein prior to injecting the second fluid into the stream of fluid, the second fluid is made substantially free of scale-forming components.

14. The method of claim 4, wherein the second fluid is inserted in the stream of fluid by injecting it into the stream of fluid via the wellbore.

15. The method of claim 14, wherein said substance is dissolved in the second fluid, the second fluid with the dissolved substance being injected into the stream of fluid.

16. The method of claim 15, wherein prior to injecting the second fluid into the stream of fluid, the second fluid is made substantially free of scale-forming components.

17. The method of claim 1, wherein the step of separating the second fluid with said at least part of the amount of the waste component included therein, from the hydrocarbon fluid, is carried out in the wellbore.

18. The method of claim 1, wherein said at least part of the amount of the waste component is induced to move into the second fluid present in the stream of fluid, as said stream flows through the wellbore.

19. The method of claim 1, wherein the second fluid comprises water.

* * * * *